US007011333B2

(12) United States Patent
Pascal

(10) Patent No.: US 7,011,333 B2
(45) Date of Patent: Mar. 14, 2006

(54) SNOWBOARD BINDING

(75) Inventor: Jean-Marc Pascal, Voreppe (FR)

(73) Assignee: Emery SA., Saint Egreve (FR)

( * ) Notice: Subject to any disclaimer, the term of this patent is extended or adjusted under 35 U.S.C. 154(b) by 134 days.

(21) Appl. No.: 10/408,413

(22) Filed: Apr. 7, 2003

(65) Prior Publication Data

US 2003/0201623 A1 Oct. 30, 2003

(30) Foreign Application Priority Data

Apr. 30, 2002 (FR) ..... 02 05462

(51) Int. Cl.
*A63C 9/00* (2006.01)

(52) U.S. Cl. ..... 280/617; 24/71 SK

(58) Field of Classification Search ..... 280/607, 280/613, 617, 618, 634, 14.21, 14.22; 24/68 SK, 24/70 SK, 71 SK
See application file for complete search history.

(56) References Cited

U.S. PATENT DOCUMENTS 3,643,295 A * 2/1972 Schoch ..... 24/70 SK
4,470,175 A * 9/1984 Chiarella ..... 24/70 SK
5,383,258 A * 1/1995 Nicoletti ..... 24/68 SK
5,852,852 A * 12/1998 Rigal ..... 24/68 R
6,076,848 A * 6/2000 Rigal et al. ..... 280/634
6,604,746 B1 * 8/2003 Sato et al. ..... 280/14.22
6,644,681 B1 * 11/2003 Couderc et al. ..... 280/602
6,773,020 B1 * 8/2004 Gonthier ..... 280/14.21
2002/0084604 A1 * 7/2002 Phillips et al. ..... 280/14.21
2003/0127832 A1 * 7/2003 Couderc et al. ..... 280/613

FOREIGN PATENT DOCUMENTS

DE 195 04 026 8/1996
EP 401402 * 12/1990

* cited by examiner

*Primary Examiner*—Bryan Fischmann
(74) *Attorney, Agent, or Firm*—Burr & Brown

(57) ABSTRACT

A binding for a snowboard includes a baseplate and at least one strap formed of strap parts that are each articulated relative to a side of the baseplate and that interact with one another in order to ensure the gripping of the strap over a boot. The strap parts are formed by curved rigid parts, the ends of which come from opposite directions toward one another, and one of the strap parts is equipped with an articulated lever allowing the displacement of a hooked zone capable of interacting with a notched zone formed on the upper face of the opposite strap part.

5 Claims, 2 Drawing Sheets

SNOWBOARD BINDING

FIELD OF THE INVENTION

The present invention relates to bindings for mounting on snowboards, the design of which makes them particularly ergonomic.

BACKGROUND OF THE INVENTION

There are a number of types of snowboard bindings, each type being more specifically suited to a particular style.

Therefore, with reference to so-called "artistic" snowboarding, more commonly known as "freestyle", use is made of relatively soft boots that allow the user great freedom of movement, permitting great variations in the angle of the tibia relative to the foot. Such qualities are particularly appreciated for snowboarding on semicylindrical trails, which are more commonly known as "half pipes".

By virtue of the flexibility of his boots, the snowboarder is able to adopt positions that are particularly inclined relative to the board. The relative flexibility of the boots also allows good perception of the sensations coming from the board. The use of such soft boots requires, however, the use of bindings that have a certain stiffness, particularly in order to withstand rearward bearing forces.

As regards so-called "downhill" snowboarding, requirements in terms of the precision of curves are all the more important, and therefore the bindings must have an even more accentuated stiffness.

Therefore, such bindings have a baseplate for mounting on the board and a highback for receiving the rear of the user's boot upper and the bearing forces of the rear of the leg. Such a highback may extend as far as halfway up the calf. The set of straps makes it possible to hold and to grip the boot inside the binding. Such straps generally pass over the front of the foot and at the instep and connect the two sides of the baseplate. More precisely, each strap generally consists at least one strap part that is fixed on the side of the baseplate. This strap part is able to interact either with a complementary strap part located on the other side of the baseplate or even with a fastening mechanism associated with the other side of the baseplate.

In order to adjust the longitudinal position of the strap part or parts on the boot, reasonably high over the instep or more or less to the front of the front end of the boot, an intermediate part is mounted on the baseplate and has the ability to pivot on an axis that is substantially transverse relative to the baseplate or relative to the lateral side of the boot. The strap part or parts are secured to this intermediate part.

Conventionally, such strap parts consist of a flexible material. In fact, such strap parts must be able to be offset on both sides of the binding in order to allow the user to insert his boot into the binding and then to close the straps over one another. In fact, the straps must be relatively flexible in order to be able to be offset easily, so as to clear the central space of the baseplate for insertion of the boot. The materials of the molded plastics type and foams may be used.

However, too great a flexibility of the strap parts may make them fragile.

Owing to the relative flexibility of the strap parts, they tend to fold down unexpectedly or to become wedged under the sole of the boot or even to become wedged between the highback and the boot when the binding is subjected to transverse movements, for example when the user steps into the binding or when the snowboard is being carried.

This tendency is further increased owing to the fact that the strap parts are generally equipped with a pad in the terminal portion, the purpose of this pad being to distribute and attenuate the pressure exerted by the strap on the user's foot. The presence of this relatively large mass at the end of the strap parts very easily gives rise to the flexible undulation of the latter. Moreover, the fastening mechanism and its component parts also have a mass that causes the strap parts to move in all directions.

Document DE-44,16,024 discloses a snowboard binding with strap parts that are articulated relative to a baseplate. The strap parts extend in the region of the articulation via rigid branches that are secured and at right angles relative to the strap parts, and lying in the inner space of the bindings. These branches are capable of receiving the bearing forces of the foot when the user steps into the binding. The strap parts are thus automatically positioned above the boot such that the user has only to carry out the operations of positioning the fastening means.

This solution has proved to be complex and totally unsuitable for bindings with strap parts that have the ability to pivot on an axis transverse relative to the baseplate. This solution also requires major modifications to the baseplate and to the straps as compared to a conventional, existing snowboard binding.

SUMMARY OF THE INVENTION

A first problem that the invention proposes to solve is that of imparting stiffness to all the elements of the binding, given that these elements have a point of articulation. A second problem that is posed is that of designing a binding that allows the user to step into it easily. A third problem is that of eliminating the inconvenience caused to the user owing to the fact that the strap parts are able to move inopportunely in a number of ways.

A snowboard binding includes a baseplate and at least one strap formed of strap parts that are each articulated relative to a side of the baseplate and that interact with one another in order to ensure gripping of the strap over a boot.

According to a first aspect of the invention, the snowboard binding is defined in that the strap parts are formed of curved rigid parts. The ends of the curved rigid parts come opposite one another. One of the strap parts is equipped with an articulated lever allowing the displacement of a hooked zone. This hooked zone is capable of interacting with a notched zone produced on the upper face of the opposite strap part.

"Rigid parts" are understood to mean parts that are unable to deform under their own weight. In other words, owing to their stiffness, the end of the strap parts that equip the bindings according to the invention has only a circular path relative to the point of attachment to the baseplate. This also means that the strap part can no longer impede the user's operations. Even when the open binding undergoes large-amplitude movements, the strap parts retain their geometry and may be used immediately by the user without the latter having to reset them.

When the strap parts are in the closed position, placed over the binding of the boot, and even when they are unfastened, they do not fall back unexpectedly on either side of the boot without the user carrying out the appropriate operation.

Preferably, the length of the link between the articulated lever and the hooked zone may be adjustable. Thus, these two strap parts may, for example, lay on the snowboard boot when the latter is positioned in the binding such that fastening takes place substantially in the central region of the boot.

In order to provide both stiffness and comfort for the user, at least one of the strap parts may be equipped on its lower face with a pad for coming into contact with the boot. The pad may, for example be arranged under the strap part that includes the notched zone.

The curved rigid parts of the strap parts each favorably comprise a hinge allowing the strap part to pivot in order to open and close the binding. The articulation of the strap parts is either directly on the baseplate of the binding or in the region of a part that is itself fixed on the bindings. This intermediate part may itself be articulated on the baseplate in order to allow pivoting of the strap relative to an axis that is substantially transverse relative to the lateral side of the boot.

In a particularly favorable manner, each strap part may have two stable equilibrium positions. These two positions are an open position, in which the strap part is clear of the front of the boot, and a closed position, in which the strap part is folded over the front of the binding in order to interact with the fastening means. The articulation of the strap part relative to the binding is thus arranged such that, between these two positions, and without the user's intervention, the strap part is biased toward one of the two stable positions.

Thus, the user has to exert a sufficiently intense force in order to counteract the characteristic articulation and to move the rigid strap parts from one stable position to the other stable position.

According to a second aspect of the invention, a snowboard is defined in that it comprises a binding as described above.

BRIEF DESCRIPTION OF THE DRAWINGS

The invention will be properly understood and its various advantages and different characteristics will become more apparent from the following description of the non-limiting illustrative embodiment, with reference to the appended diagrammatic drawings in which.

DETAILED DESCRIPTION OF THE INVENTION

Figure 1:
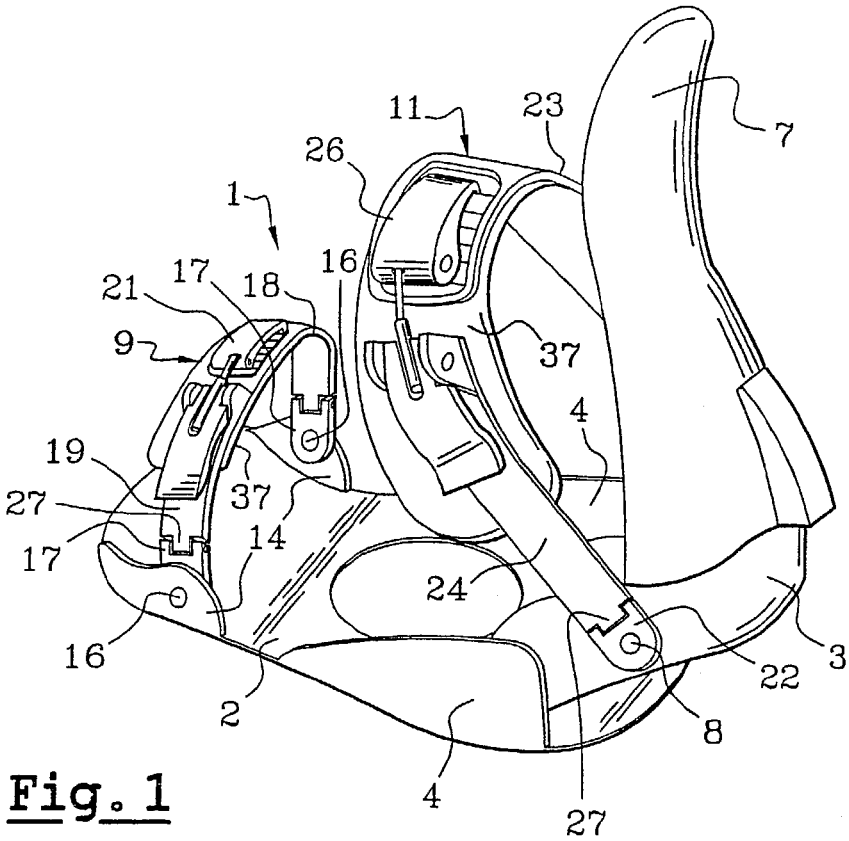
FIG. 1 shows a rear, perspective view of a snowboard binding according to the invention.
Figure 2:
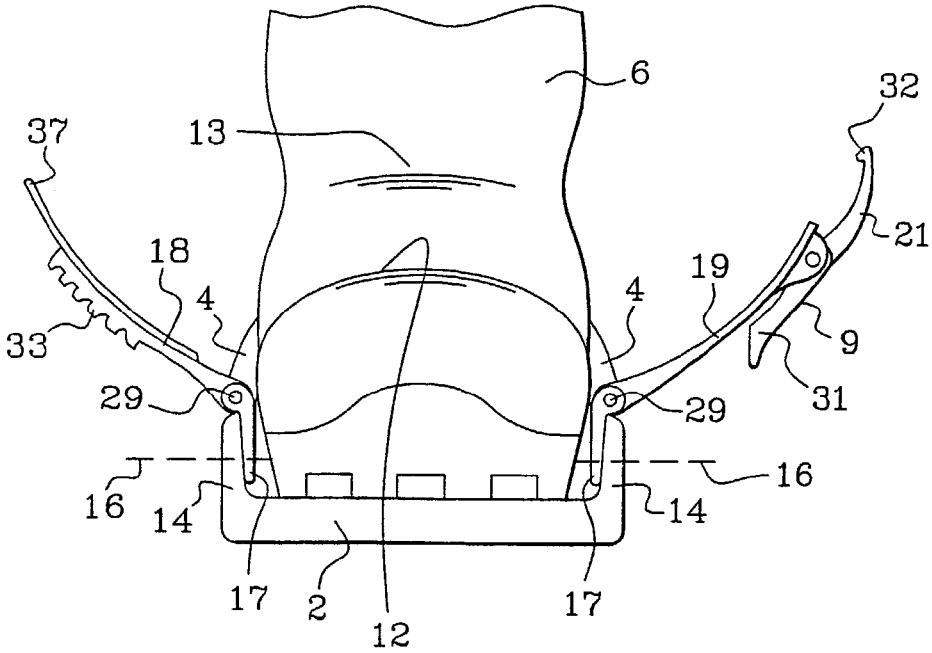
FIG. 2 shows a front view of the binding, with a boot, and with the rear binding straps removed.
Figure 3:
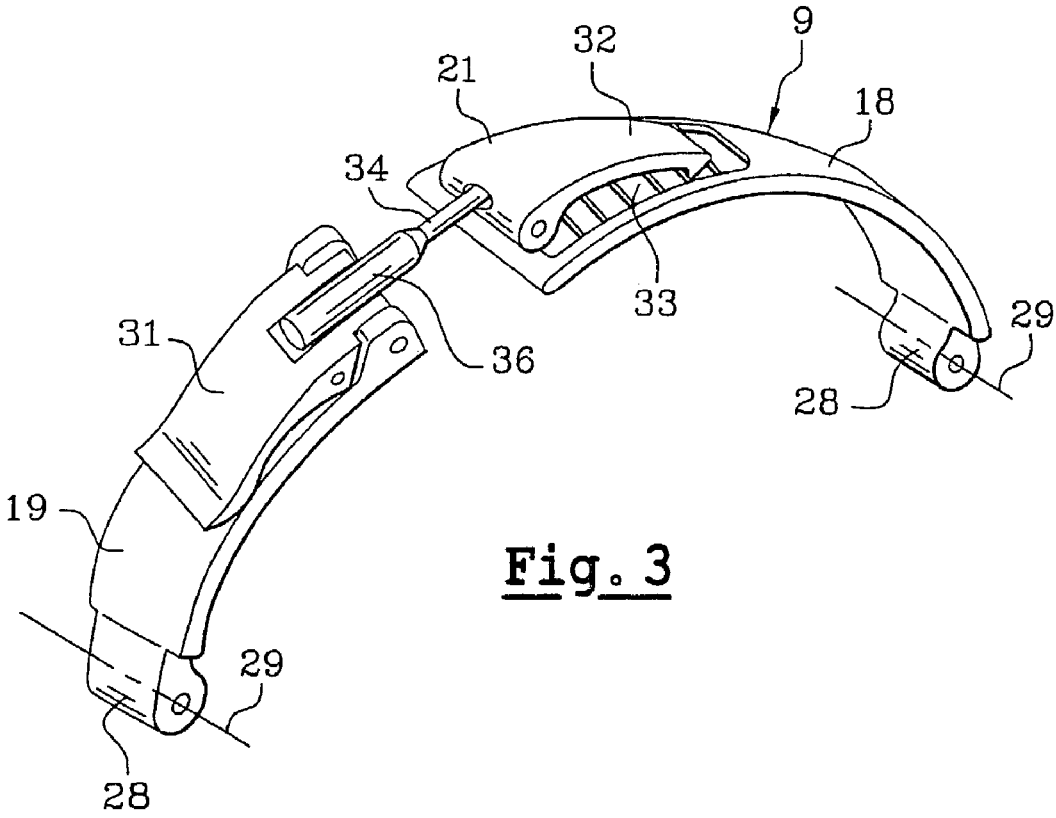
FIG. 3 shows a perspective view of two of the strap parts for the binding.

A snowboard binding (1) comprises a baseplate (2) for mounting on the snowboard (not shown). At the rear of the baseplate (2) is fixed a heel loop (3) connecting two rear flanks (4) of the baseplate (2), passing behind the heel of the boot (6).

This heel loop (3) receives a highback (7) for coming into contact with the rear part of the upper of the boot (6), in order to receive the bearing forces of the rear of the leg. The highback (7) is mounted pivotably relative to the heel loop (3) by means of two pivot pins (8). By virtue of this arrangement, it is possible to fold down the highback (7) when the binding (1) is no longer in use and thus to limit its overall bulk and facilitate its storage.

Traditionally, such a binding (1) comprises retention means that hold the boot (6) of the user in the binding (1). These retention means take the form of two gripping straps (9 and 11). The first of these gripping straps (9), known as the front strap, is generally arranged in the region of the front end of the binding (1) so as to lie on the zone (12) at the front of the boot (6) in the region of the toes. The second of these gripping straps (11), known as the rear strap, is generally arranged in the region of the instep (13) of the boot (6).

The front strap (9) is fixed on two front flanks (14) of the baseplate (2). The front strap (9) is mounted pivotably relative to these front flanks (14) by means of two pivot pins (16). In order to obtain the above, two front intermediate parts (17) are pivotably secured, for example by means of screwing, to the inside of the front flanks (14) in the inner zone of the binding (1). It will be noted that the front strap (9) may also be mounted directly on the front flanks (14), but it will then have no ability to move and thus no ability to be adjusted forward or rearward.

A right front strap part (18) and a left front strap part (19) form the front strap (9). The right front strap part (18) and the left front strap part (19) come opposite one another and interact together. Front fastening means (21) provided on these two right (18) and left (19) front strap parts allow the precise positioning of the right front strap part (18) relative to the left front strap part (19), and thus the gripping of the boot (6).

The rear strap (11) is fixed on the heel loop (3) of the baseplate (2). The rear strap (11) is mounted pivotably relative to this heel loop (3) by means of two pivot pins (8) already provided for the rocking of the highback (7). To obtain the above, two rear intermediate parts (22) are pivotable and secured, for example by means of screwing, to the outside of the heel loop (3) in the outer zone of the binding (1). It will be noted that the rear strap (11) may also be mounted directly on the heel loop (3) but that it will then have no ability to move and thus no ability to be adjusted forward and rearward.

A right rear strap part (23) and a left rear strap part (24) form the rear strap (11). The right rear strap part (23) and the left rear strap part (24) come opposite one another and interact together. Rear fastening means (26) provided on the two right (23) and left (24) rear strap parts allow the precise positioning of the right rear strap pat (23) relative to the left rear strap part (24) and thus the gripping of the boot (6).

In order to allow the operations of opening and closing the front (9) and rear (11) straps, the pivot movements of the strap parts (18, 19, 23 and 24) relative to the baseplate (2) are obtained by means of an articulation forming a hinge (27). At one of their ends, opposite the fastening means (21, 26), the curved rigid parts of the right front strap part (18), of the left front strap part (19), of the right rear strap part (23) and of the left rear strap part (24) each comprise a protrusion (28). This protrusion (28) is centered, slightly swollen and hollow, it being possible for a pin (29) to pass inside the hollow. In a complementary manner, the two front intermediate parts (17) and the two rear intermediate parts (22) comprise a double boss that surrounds the protrusion (28). This double boss is slightly swollen and hollow, it being possible for the pin (29) to pass inside the double hollows.

The pin (29) secures together the strap parts (18, 19, 23 and 24) and the corresponding intermediate parts (17, 22). To allow a movement for opening and closing the strap parts (18, 19, 23 and 24), the pin (29) is thus substantially parallel to the front flanks (14) of the baseplate (2) or to the tangent to the heel loop (3) in the region of the pivot pin (8). The articulation that forms the hinge (27) may also be bistable, for example with a swollen zone engaging with a flexible blade.

The front fastening means (21) are substantially identical to the rear fastening means (26). These front (21) and rear (26) fastening means comprise an articulated lever (31) at the free end of the left front strap part (19) and of the left rear strap part (24). This articulated lever (31) pivots and allows the displacement of a zone ending in a hook (32). This hook (32) engages in a notched zone (33) made on the upper face at the free end of the opposite strap part, i.e. of the right front strap part (18) and of the right rear strap part (23), respectively.

In order to allow extremely precise gripping of the boot (6), the length of the link between the articulated lever (31) and the hooked zone (32) is adjustable. For this purpose, a threaded rod (34), that can be actuated by a screwdriver, turns in a corresponding tapped housing (36).

According to the invention, the right front strap part (18) and the left front strap part (19) are each formed by a curved rigid part. According to the invention, the right rear strap part (23) and the left rear strap part (24) are each formed by a curved rigid part.

The materials used for all the curved strap parts (18, 19, 23, 24) have a stiffness that is close, for example, to that of shaped aluminum. The curved rigid parts are thus made from non-deformable rigid molded polymer materials, or even from aluminum. The curved rigid parts may be covered with a supplementary coating, of the foam, fabric, etc. type.

The radius of curvature of the right front strap part (18) and of the left front strap part (19) corresponds substantially to the curvature of the zone at the front (12) of the boot (6). The radius of curvature of the right rear strap part (23) and of the left rear strap part (24) corresponds substantially to the curvature of the instep (13) of the boot (6).

In order to improve the comfort of the straps (9 and 11) of the binding (1), the right front (18) and right rear (23) strap parts each comprise a pad (37). The pad (37) is positioned on the lower face that comes into contact with the boot (6). The pad is arranged under the notched zone (33).

The present invention is not limited to the embodiments described and illustrated. A number of modifications may be made without thereby departing from the context defined by the scope of the set of claims.

The invention claimed is:

1. A binding for a snowboard, comprising:

a baseplate; and at least one strap including first and second opposing strap parts each having a first end, a second send, and a curved rigid part on an upper face thereof, said first ends of said opposing strap parts extending from and being articulated relative to opposing sides of said baseplate, wherein said second end of said first opposing strap part includes a hook member connected to an articulated lever such that said hook member is displaceable toward a corresponding notch member on said second end of said second opposing strap part and said hook and notch members on said curved rigid part of said first and second opposing strap parts are brought together and fastened to one another over a portion of a boot, and wherein said opposing strap parts each comprise a hinge that makes it possible to pivot said strap parts in order to open and close the binding.

2. The binding as claimed in claim 1, further comprising a linking member between said articulated lever and said hook member, and a length of said linking member is adjustable.

3. The binding as claimed in claim 1, wherein at least one of said opposing strap parts further comprises a pad on a lower face portion thereof contacting said boot.

4. The binding as claimed in claim 3, wherein said pad is arranged under a portion of said second opposing strap part including said notch member.

5. The binding as claimed in claim 1, wherein each of said first and second opposing strap parts has two stable equilibrium positions including an open position in which said opposing strap parts are free from said boot and a closed position in which said opposing strap parts are folded down over a front of said binding such that said hook and notch members interact with one another, and wherein articulation of each of said first and second opposing strap parts relative to said binding is biased toward one of said open and closed positions.

* * * * *